US010907942B2

(12) United States Patent
Greenwood

(10) Patent No.: US 10,907,942 B2
(45) Date of Patent: Feb. 2, 2021

(54) SHAFTS WITH REINFORCING LAYER FOR SPORTING GOODS AND METHODS OF MANUFACTURE

(71) Applicant: Aldila Golf Corporation, Carlsbad, CA (US)

(72) Inventor: Stephen Greenwood, Brea, CA (US)

(73) Assignee: Aldila Golf Corporation, Carlsbad, CA (US)

( * ) Notice: Subject to any disclaimer, the term of this patent is extended or adjusted under 35 U.S.C. 154(b) by 0 days.

(21) Appl. No.: 15/639,654

(22) Filed: Jun. 30, 2017

(65) Prior Publication Data

US 2018/0003470 A1 Jan. 4, 2018

Related U.S. Application Data

(60) Provisional application No. 62/374,508, filed on Aug. 12, 2016, provisional application No. 62/357,778, filed on Jul. 1, 2016.

(51) Int. Cl.
*F42B 6/04* (2006.01)

(52) U.S. Cl.
CPC ..... *F42B 6/04* (2013.01)

(58) Field of Classification Search
CPC ..... F42B 6/04
USPC ..... 473/578, 44, 288, 289, 316
See application file for complete search history.

(56) References Cited

U.S. PATENT DOCUMENTS

| | | | | |
|---|---|---|---|---|
| 2003/0013565 | A1* | 1/2003 | Song | F42B 6/04 473/578 |
| 2004/0092329 | A1* | 5/2004 | Meyer | A63B 53/10 473/316 |
| 2005/0255935 | A1* | 11/2005 | Yanagisawa | A63B 53/14 473/316 |
| 2010/0323810 | A1* | 12/2010 | Kaneko | A63B 53/12 473/320 |
| 2012/0190473 | A1* | 7/2012 | Swist | A63B 49/02 473/282 |

* cited by examiner

*Primary Examiner* — John E Simms, Jr.
*Assistant Examiner* — Rayshun K Peng
(74) *Attorney, Agent, or Firm* — Stroock & Stroock & Lavan LLP

(57) ABSTRACT

Reinforcement is used in the manufacture of shafts having multiple layers with multiple types of material in various combinations for the arrows, crossbow bolts, and sporting goods of the present invention. The reinforced shaft is a cylindrical tube made of a base material with a reinforcing layer applied to the cylindrical tube. In one embodiment, the reinforced shaft is a carbon fiber blank with a steel mesh used as the reinforcing layer. The reinforcing layer applied over the carbon fiber blank increases the overall strength of the shaft.

11 Claims, 12 Drawing Sheets

SHAFTS WITH REINFORCING LAYER FOR SPORTING GOODS AND METHODS OF MANUFACTURE

CROSS-REFERENCE TO RELATED APPLICATION

This application claims the benefit of U.S. Provisional Application No. 62/357,778 filed Jul. 1, 2016, and U.S. Provisional Application No. 62/374,508 filed Aug. 12, 2016.

FIELD OF THE INVENTION

The disclosure relates to shafts for sporting goods, such as archery arrows, arrow shafts, crossbow bolts, archery bow stabilizers, golf shafts, and golf clubs. This invention relates more particularly, but not exclusively, to adding a reinforcing layer to improve the performance of sporting goods shafts.

BACKGROUND

Traditionally, arrow shafts and other sporting goods were made from wood, bamboo, and/or reeds. To decrease their weight and produce arrows that are easier to shoot and that can fly farther, and golf clubs that are easier to swing, modern arrows, golf clubs, and sporting goods are made from aluminum and carbon fiber reinforced plastic. Carbon fiber, a type of fiber reinforced plastic, has been used since the 1990s as a lightweight material used to make arrows and other sporting goods. While modern materials are lighter in weight than traditional materials, modern materials are not as durable.

Modern arrows are typically made from a carbon fiber arrow shaft that is hollow, and include an arrow tip in the front of the arrow shaft, a nock in the rear of the arrow shaft, and fletching along the surface of the arrow shaft adjacent the nock. In flight, the hollow arrow shaft flexes slightly along its length in an oscillatory motion. Specifically, the action of shooting the arrow from the bow creates a deflection along the length of the arrow, which oscillates as the arrow travels. As a result, archers generally choose the arrow shaft and its components to match their equipment and to meet their shooting requirements. This includes choosing an arrow shaft having the correct length, weight, and stiffness. Archers chose an arrow shaft with a defined static spine, which is the stiffness of the arrow shaft and its resistance to bending. Based on their chosen arrow shaft and corresponding static spine, they then add tips, fletching, and knocks to tune the dynamic spine, which is the deflection of the arrow when fired from a bow. The physical properties of the arrow shaft, including the overall weight and the center of gravity of the arrow, affects the arrow performance.

For a specific arrow shaft having a particular length and static spine, the change in weight will adversely affect the static spine of the arrow shaft. The static spine of an arrow shaft is generally determined by the material of the arrow shaft, the thickness of the arrow shaft walls, and the length of the arrow shaft. Changing weight between arrow shafts made of the same carbon fiber material with the same length requires changing the wall thickness of the arrow shaft. The thinner walled arrows shafts will be lighter, but will have a lower static spine because the stiffness of the arrow shaft would decrease. Altering any one of the properties of the arrow shaft will affect the other. This limits the ability of the archer to choose a particular carbon fiber arrow shaft having a specific weight, length, and diameter with a specific static spine.

Some arrows are constructed entirely out of aluminum or are constructed out of a hybrid aluminum and carbon composite. Arrows constructed out of a hybrid aluminum and carbon composite are generally made from an aluminum shaft and carbon that is either wrapped on the outside of the aluminum tube or molded to the inside of the aluminum tube. These arrows exhibit permanent deformation when launched and extracted from a target because of the low yield strength of aluminum. This results in a change in straightness of an arrow after repeated shooting or even after its initial shooting. The straightness of an arrow has a direct impact on the accuracy of the arrow. This creates a condition for a bent arrow that significantly reduces the accuracy of the arrow.

In light of the above, it would be advantageous to provide a lightweight arrow shaft having an overall stiffness comparable to the stiffness of a heavier arrow shaft. It would be further advantageous to provide an arrow shaft having a smaller outer diameter. It would further be advantageous to provide a thin walled arrow shaft having an overall stiffness comparable to a thicker walled arrow shaft.

SUMMARY OF THE INVENTION

The present invention is a lightweight, high-strength arrow shaft with a reinforcing layer. The reinforced arrow shaft is constructed of multiple layers. In the preferred embodiment, two different materials are used to form the reinforced arrow shaft. A carbon fiber material forms a carbon fiber blank and is wrapped with a steel material in the form of a steel wire mesh. The carbon fiber material forms the first, inner layer and the metal material forms the outer, second layer of the reinforced arrow shaft.

A principal object of the present invention is a shaft comprising a longitudinal axis, an inside diameter spanning the longitudinal axis, an outside diameter spanning the longitudinal axis, and a reinforcing layer, which may be a mesh material. The shaft can be manufactured from fiber reinforced plastic, such as carbon fiber, or other materials generally known and used in the archery and sporting goods industries. The reinforcing layer increases strength, such as hoop and compressive strength, speed, durability, and dynamic response.

One object of the present invention is an arrow shaft comprising a longitudinal axis, an inside diameter spanning the longitudinal axis, an outside diameter spanning the longitudinal axis, and a reinforcing layer, which may be a mesh material.

One object of the present invention is a method of making a shaft comprising fiber reinforced plastic, comprising a longitudinal axis, an inside diameter spanning the longitudinal axis, an outside diameter spanning the longitudinal axis, and a reinforcing layer, which may be a mesh.

One object of the present invention is a carbon fiber arrow shaft comprising rolled unidirectional carbon fiber comprising a longitudinal axis, an inside diameter spanning the longitudinal axis, an outside diameter spanning the longitudinal axis, and a reinforcing layer, which may be a mesh. Another object of the present invention is a method of making an arrow shaft comprising rolling a first unidirectional carbon fiber around a mandrel to form a carbon fiber core having a longitudinal axis, an inside diameter spanning the longitudinal axis, a reinforcing layer, which may be a mesh, and an outside diameter spanning the longitudinal axis. In one embodiment the method further comprises wrapping a second unidirectional carbon fiber around the carbon fiber core to form the arrow shaft.

In the preferred embodiment, the reinforcing layer is a sheet of mesh material. The reinforcing layer is a sheet of metal mesh with an 80×80 wires per inch$^2$ with a wire diameter of 0.001-0.002 inches. The pattern of the steel mesh is a plain weave where the warp wire (wire running-parallel to length of the mesh material) passes alternately over and under the wires running traversely through the mesh material (fill or shoot wires) at 90 degree angles. The reinforcing layer is oriented where the warp wire is parallel with the length of the carbon fiber blank and the fill wire is perpendicular with the length of the carbon fiber blank, or vice versa. By orienting the mesh in this particular manner, the reinforcing layer provides additional strength to the carbon fiber blank. The result is a high-strength arrow shaft.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

The description that follows includes preferred embodiments of the present invention, which are exemplary and specifically described with reference to the drawings. However, dimensions, materials, shapes, relative arrangements, and other constituent elements described in the following embodiments may be changed depending on the conditions of the various elements or devices or apparatuses to which the present invention is applied. Therefore, the scope of the present invention is not limited to the precise disclosure unless otherwise specified. For example, while the disclosure generally relates to archery arrows, arrow shafts, crossbow bolts, and archery bow stabilizers, a person of skill in the art would appreciate that the teachings are applicable to all sporting goods shafts, including golf shafts and golf clubs.

Figure 1:
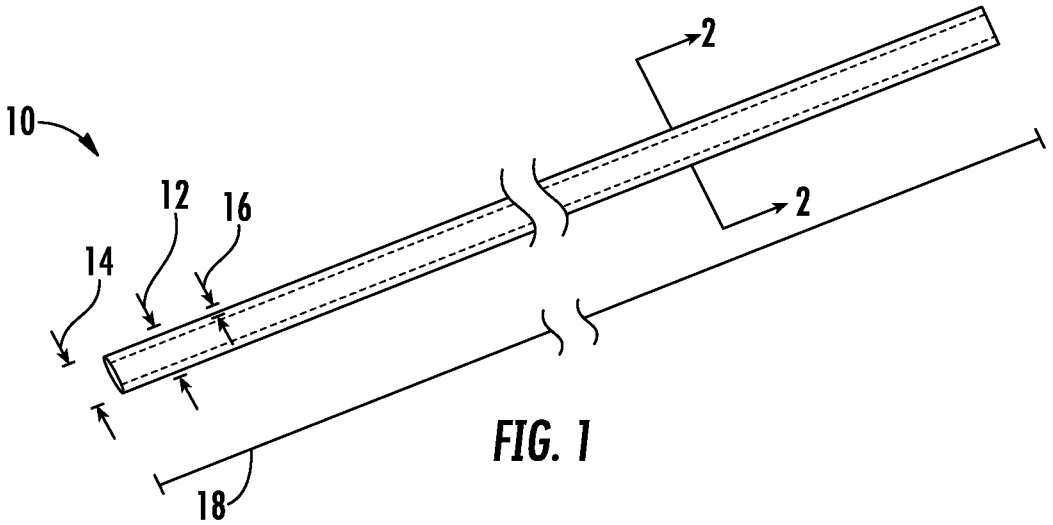
FIG. 1 is a perspective view of the preferred embodiment of the reinforced arrow shaft.
Figure 2:
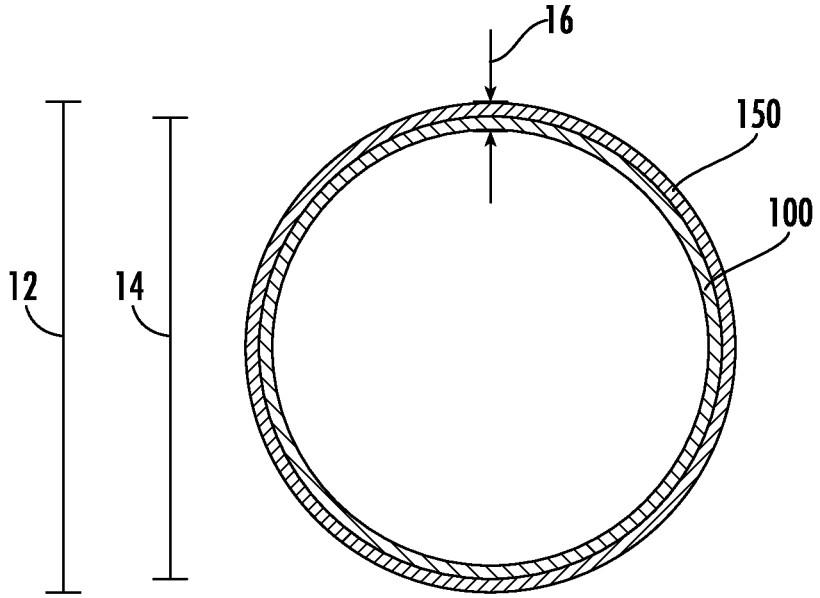
FIG. 2 is cross-section view of the reinforced arrow shaft taken along line 2-2 of FIG. 1.
Figure 6:
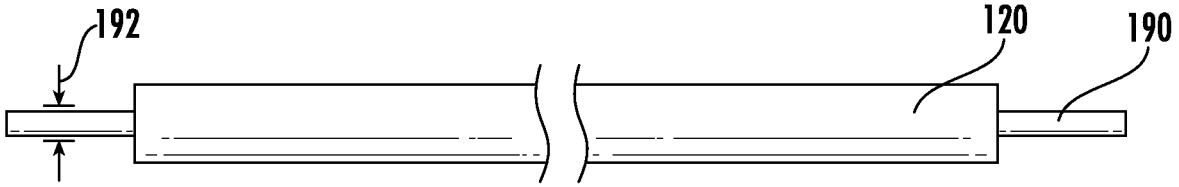
FIG. 6 is a side view of a mandrel with carbon fiber material wrapped around the mandrel.
Figure 7:
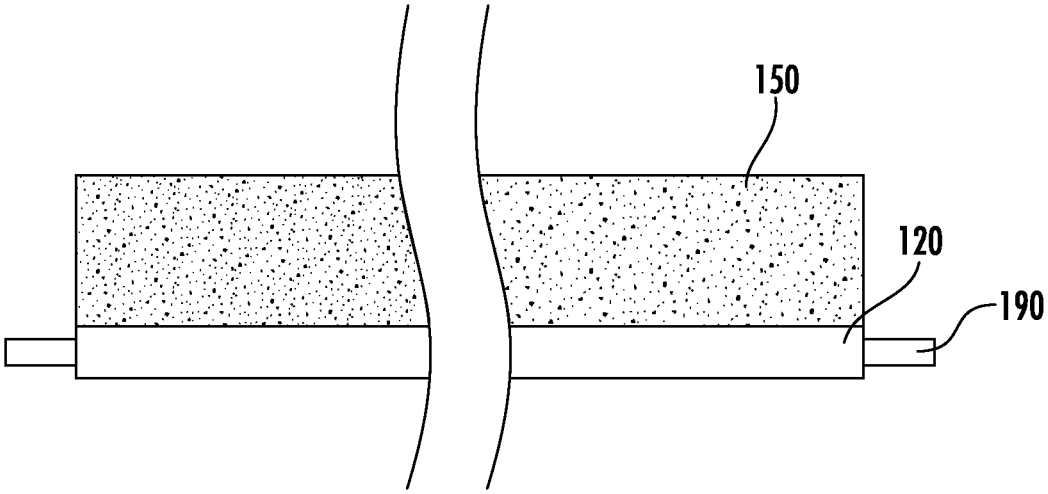
FIG. 7 is a side view of the mandrel with carbon fiber material wrapped around the mandrel being wrapped with a reinforcing layer.
Figure 8:
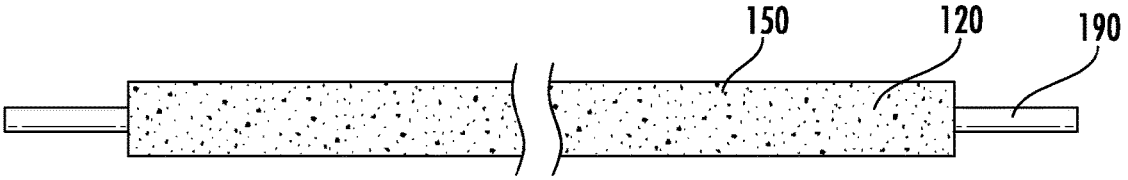
FIG. 8 is a side view of the mandrel with the reinforcing layer wrapped around the carbon fiber material wrapped around the mandrel.
Figure 9:
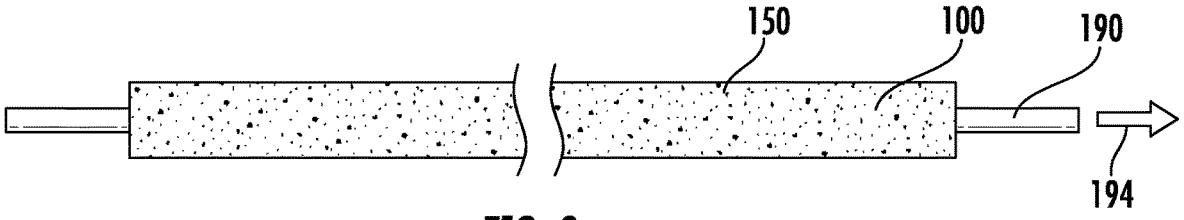
FIG. 9 is a side view of the reinforced arrow shaft being removed from the mandrel.

Referring initially to FIG. 1, a perspective view of a preferred embodiment of a reinforced arrow shaft is shown and generally designated 10. Reinforced arrow shaft 10 has an outside diameter 12, an inside diameter 14, a wall thickness 16, and a length 18. The reinforced arrow shaft 10 is constructed of multiple layers. In the preferred embodiment, the reinforced arrow shaft has two layers, each made of a different material. A carbon fiber material 120 (shown in FIG. 6) forms a carbon fiber blank 100 which is wrapped with a reinforcing layer 150 (shown in FIG. 2), such as a metal mesh, for instance, a stainless steel mesh. The carbon fiber material 120 forms the first, inner layer and the reinforcing layer 150 forms the outer, second layer of the reinforced arrow shaft 10. It is contemplated that in alternative embodiments, multiple layers may be used with multiple different materials, in multiple different combinations.

In a preferred embodiment, the reinforcing layer 150 is a sheet of metal mesh with an 80×80 wires per inch$^2$ with a wire diameter of 0.001-0.002 inches. In the preferred embodiment, the reinforcing layer 150 is a stainless steel mesh. The pattern of the steel mesh is a plain weave where the warp wire (wire running-parallel to length of the mesh material) passes alternately over and under the wires running traversely through the mesh material (fill or shoot wires) at 90 degree angles. Reinforcing layer 150 is oriented where the warp wire is parallel with the length of the carbon fiber blank 100 and the fill wire is perpendicular with the length of the carbon fiber blank 100, or vice versa. By orienting the mesh in this particular manner, the reinforcing layer provides additional hoop strength to the carbon fiber blank 100. It is contemplated that the angle of the mesh wires may be varied according to application and desired overall strength of the arrow shaft 10. It is further contemplated that the number of wires per inch and wire diameter may be changed to fit the strength characteristics desired for the reinforced arrow shaft 10. The type of metal used for the metal mesh is not meant to be limiting and the determination of type of metal used will be determined by the strength characteristics desired for the reinforced arrow shaft 10. It is also contemplated that the reinforcing layer 150 may be made of alternative types of materials beside metal.

Figure 3:
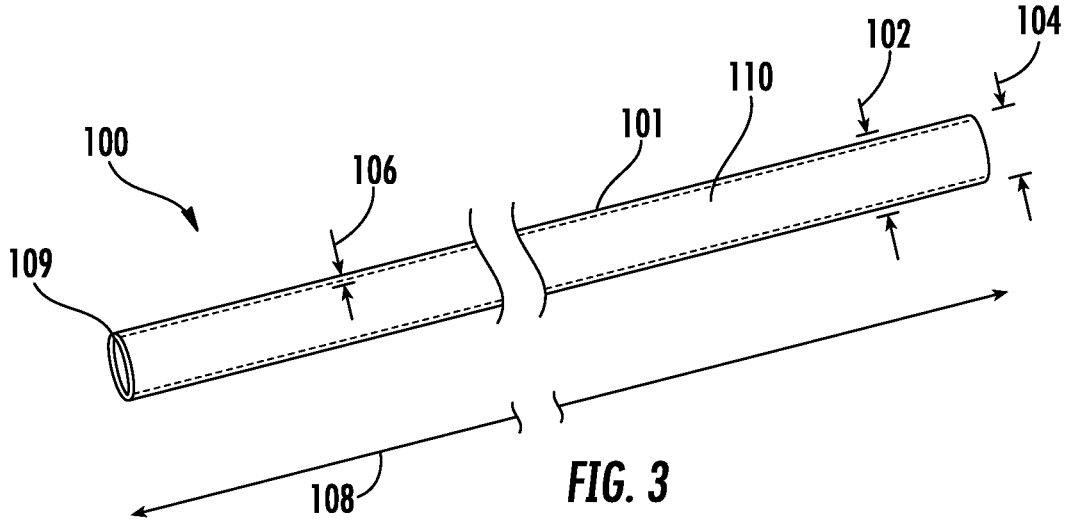
FIG. 3 is a perspective view of a carbon fiber blank.

Referring now to FIG. 3, carbon fiber blank 100 consists of a cylindrical tube 101 having an outside diameter 102, an inside diameter 104, a wall thickness 106, and a length 108. The cylindrical tube 101 has an unfinished exterior 110. In a preferred embodiment, cylindrical tube 101 is made from a carbon fiber material or a composite material composed in part of carbon fiber. However, other materials, such as wood or metal, are fully contemplated without departing from the spirit of the invention. Due to the nature of carbon fiber, exterior surface 110 of the cylindrical tube 101 is unfinished and contains surface irregularities, which may cause the cylindrical tube 101 to exceed the dimensions required for the finished reinforced arrow shaft 10. To prepare cylindrical tube 101 for receiving a reinforcing layer 150 (shown in FIG. 4), exterior surface 110 is ground to remove imperfections and to meet the desired physical properties, such as diameter and straightness.

Figure 4:
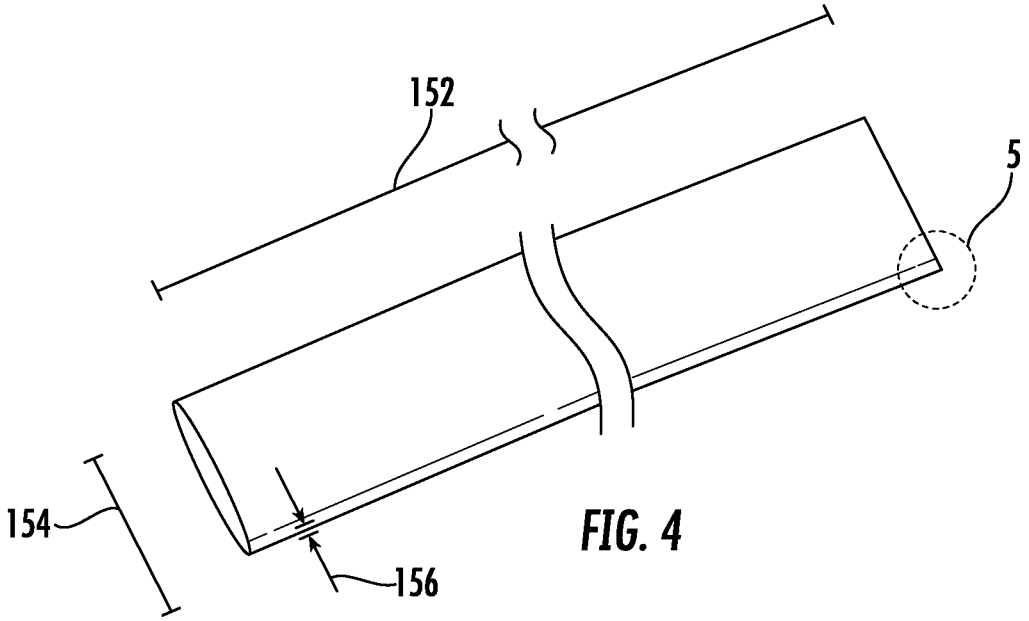
FIG. 4 is a perspective view of a reinforcing layer.
Figure 5:
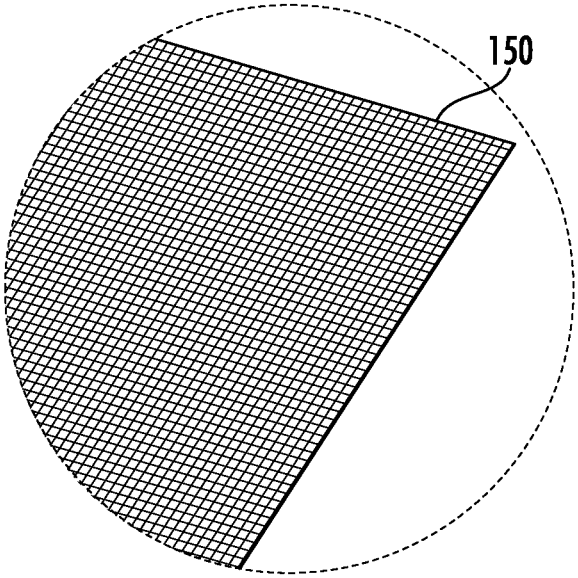
FIG. 5 is a close up view of the reinforcing layer showing the weave pattern of the reinforcing layer.
Figure 5A:
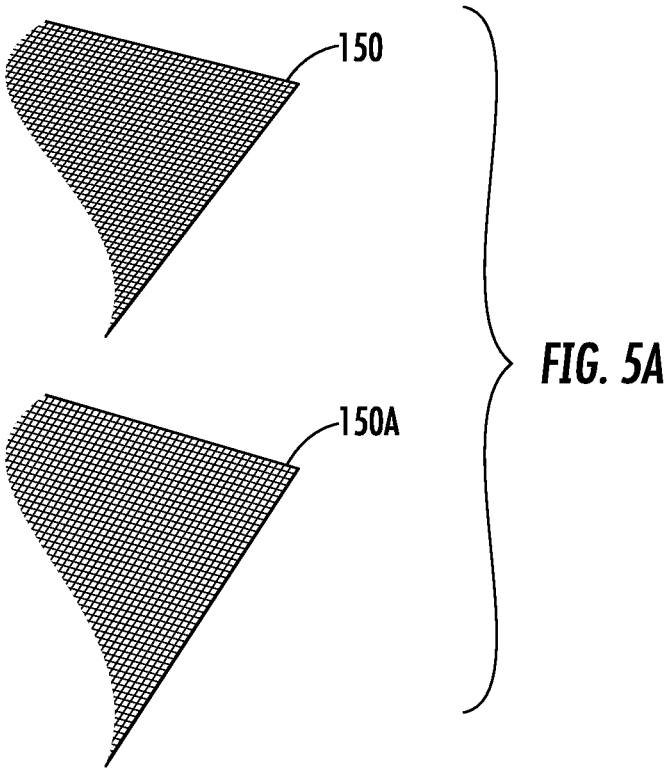
FIG. 5A is a close up view of the reinforcing layer showing the weave pattern of the reinforcing layer.

Referring now to FIG. 4, in conjunction with FIG. 5, reinforcing layer 150 is shown. In the preferred embodiment, the reinforcing layer 150 is a sheet having a length 152, width 154, and thickness 156. The length 152 of the reinforcing layer 150 is equal to or substantially equal to the length 108 of the cylindrical tube 101. The width 154 of the reinforcing layer is equal to or substantially equal to the circumference 109 of the cylindrical tube 101. In the preferred embodiment, the reinforcing layer 150 is a sheet of stainless steel mesh with an 80×80 wires per inch$^2$ mesh and a wire diameter of 0.001-0.002 inches. The addition of the weight of the steel metal mesh is 1.2 grains/inch. The addition of the reinforcing layer 150 that is a steel metal mesh increases the strength of the arrow shaft 10 while only adding minimal weight. Further, multiple reinforcing layers 150 and 150A may be used with each reinforcing layer 150 and 150A oriented at a different angle (see FIG. 5A).

The mesh can be manufactured in any way known to a person having skill in the art. The mesh can be any type of mesh, including, but not limited to, fabric filter cloths. The mesh can be a woven or knitted mesh and can have any weave or knit known to a person having skill in the art. Non-limiting examples of such weaves include plain weave, regular weave, twill weave, flat tow weave, plain Dutch weave, and reverse Dutch weave.

The mesh can be made from any material known to a person having skill in the art. Non-limiting examples of the materials that can be used for the mesh include aluminum, steel, stainless steel, brass, titanium, nickel, silver, a synthetic fiber, such as nylon or poly-paraphenylene terephthalamide, or any combination or alloy thereof. A person having skill in the art would know to use any material, or a combination or alloy thereof, to achieve a desired ultimate tensile strength and/or yield strength. In one embodiment, the alloy used is nitinol.

The mesh can be modified from as low as 20 mesh to up to 500 mesh. A person having skill in the art would modify the mesh to achieve a preferred density for the arrow. A person having skill in the art can adjust the mesh from one end of the arrow to the other to tune the arrow. Modifying the number of wires per inch as well as varying the wire diameters in the warp and weft directions can achieve preferable results, such as faster arrow recovery, deeper penetration greater stored kinetic energy, increased structural durability, as well as changing the front of center balance of the arrow.

In one embodiment of the invention, the mesh material is a woven 304 stainless steel, with 200 mesh (0.002 inch thick wire×0.002 inch thick wire). In another embodiment, the mesh material is a Dutch weave using a 0.0032 inch (0.0813 mm)×0.0018 inch (0.04572 mm) thick wire, in which the 0.0032 inch wire is in the warp direction, which runs parallel along the longitudinal length of the arrow, and the 0.0018 inch wire will be the weft which will wrap around the tube.

Referring now to FIGS. 6-9, a manufacturing method for the arrow shaft 10 is shown. Carbon fiber manufacturing is known in the art, and includes the wrapping of carbon fibers around a mandrel and impregnated with epoxy which is then heated and formed into the desired article of manufacture. The shaft can be formed by rolling a first unidirectional carbon fiber around a mandrel to form a carbon fiber core. The unidirectional carbon fiber material can be cut patterns of unidirectional carbon fiber. In one embodiment, the unidirectional carbon fiber is rolled at an essentially 0 degree angle. A second unidirectional carbon fiber can be wrapped around the tubular core to form the arrow shaft. In one embodiment, the second unidirectional carbon fiber is wrapped at an essentially 90 degree angle. In another embodiment, the second unidirectional carbon fiber is wrapped at an essentially 45 degree angle. In an embodiment, the second unidirectional carbon fiber is a woven material.

For the present invention, a side view of the manufacturing method shows the use of mandrel 190 with diameter 192 wrapped with carbon fiber material 120. After applying the carbon fiber material 120 around the mandrel 190, the reinforcing layer 150 is applied around the carbon fiber material 120. The diameter 192 of the mandrel 190 forms the interior diameter 14 of the arrow shaft 10 and the amount of carbon fiber material 120 wrapped around the mandrel 190 in conjunction with the thickness of the reinforcing layer 150 forms the exterior diameter 12 of the arrow shaft 10. After curing the carbon fiber material 120 wrapped with the reinforcing layer 150, the mandrel 190 is removed in direction 194 leaving an arrow shaft 10 with a carbon fiber blank 100 with a reinforcing layer 150. The carbon fiber blank 100 with a reinforcing layer 150 is finished into the arrow shaft 10.

The carbon fiber material 120 can be made by molding fiber reinforced plastic, pultruding carbon fiber, or casting or extruding a metal, such as aluminum. One non-limiting type of carbon fiber is "pre-preg," which is a carbon fiber material pre-impregnated with a resin. The carbon fiber material 120 can be formed from any material known to those of skill in that art. The carbon fiber material 120 can also be formed by shaping fiber reinforced plastic, carbon fiber, or extruding aluminum around a mandrel.

The reinforcing layer 150 can be fiber reinforced plastic, pultruding carbon fiber, or casting or extruding a metal sleeve, such as aluminum. The reinforcing layer 150 can be formed from any material known to those of skill in the art. The material used for the reinforcing layer 150 can be the same as, or different from, the material used to form the carbon fiber material 120. By way of non-limiting example, the carbon fiber material 120 can be made of a metal, such as aluminum, and the reinforcing layer 150 can be made of a fiber reinforced plastic, such as carbon fiber; the carbon fiber material 120 can be made of a fiber reinforced plastic, such as carbon fiber, and the reinforcing layer 150 can be made of a metal, such as aluminum; the carbon fiber material 120 and the reinforcing layer 150 can both be made of a fiber reinforced plastic; or the carbon fiber material 120 and the reinforcing layer 150 can both be made of a metal.

The reinforcing layer 150 can be part of the construction of the carbon fiber material 120. The reinforcing layer 150 can be part of the carbon fiber material 120 or it can be added or layered over the carbon fiber material 120, or in any layer or any successive layer that surrounds the carbon fiber material 120. The reinforcing layer 150 can be used on all or only a portion of the shaft. Different reinforcing layers 150 or meshes may be used in or on the shaft. In one embodiment, the reinforcing layer 150 is a layer that spans the longitudinal axis of the shaft. In one embodiment, the reinforcing layer 150 is part of the carbon fiber material 120 of the shaft. In one embodiment, the reinforcing layer 150 is part of the outer diameter of the shaft. In one embodiment, the reinforcing layer 150 is a layer of the shaft. In one embodiment, the reinforcing layer 150 is on an arc of the shaft. In one embodiment, the reinforcing layer 150 spans the entire shaft.

Figure 10:
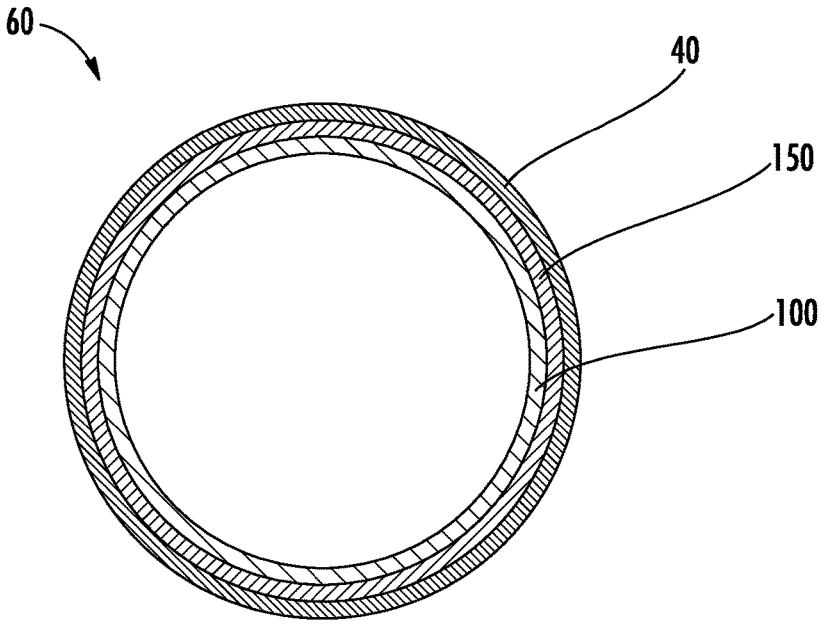
FIG. 10 is a cross-section view of a reinforced arrow shaft comprising a carbon fiber blank with applied reinforcing layer and finishing layer.

Referring now to FIG. 10, a cross-section view of an alternative embodiment of the reinforced shaft of the present invention is shown and generally designated 60. Reinforced shaft 60 includes a carbon fiber blank 100, a reinforcing layer 150, and a finishing layer 40. The finishing layer 40 covers any seams resulting from production and provides added protection from cuts, chips, scratches, and abrasions.

Figure 11:
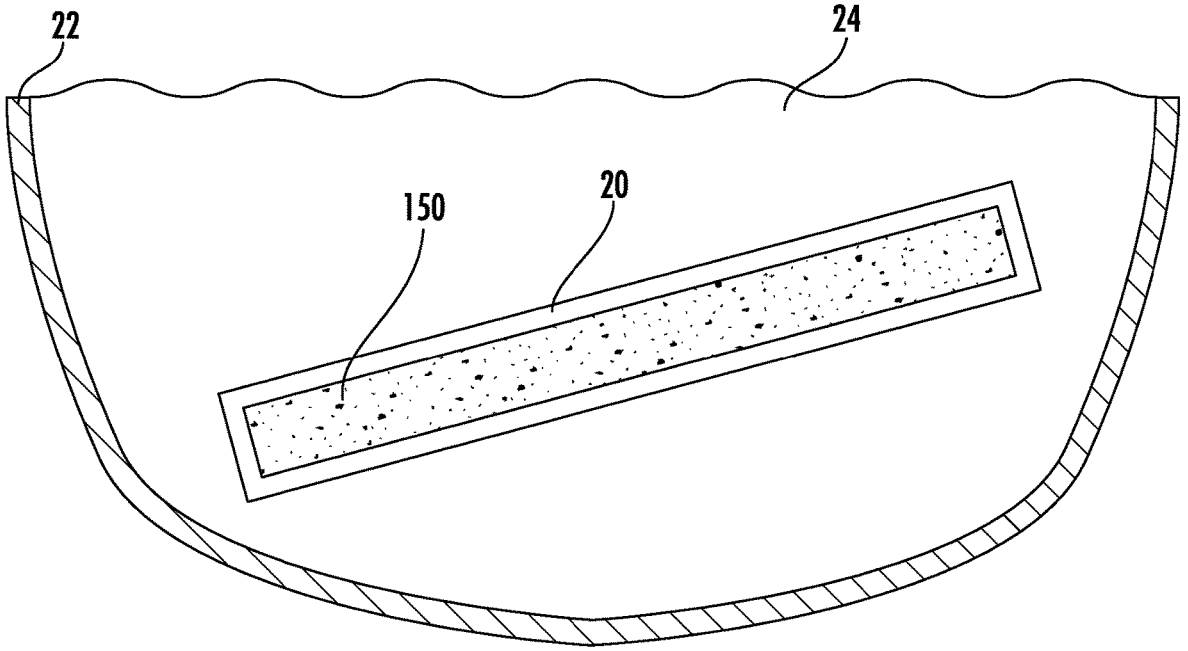
FIG. 11 is a perspective view of a reinforcing layer applied to a backing and submerged into a solvent in preparation for application to the carbon fiber blank.

Referring now to FIG. 11, a side view of a solvent solution 24 within a container 22, showing the reinforcing layer 150, mounted to a backing 20, submerged in the solvent solution 24. Reinforcing layer 150 and backing 20 are submerged until both are thoroughly wet, typically 5-10 seconds. It is to be appreciated by one skilled in the art that the type and concentration of solvent used, as well as soak times, may vary depending on the type of adhesive used to adhere the reinforcing layer 150 to the backing 20. If reinforcing layer 150 and backing 20 are soaked to the point that reinforcing layer 150 detaches or starts to detach from backing 20, reinforcing layer 150 and backing 20 are no longer usable and should be discarded. The reinforcing layer 150 should remain with the backing 20 when it is pulled from the solvent. The reinforcing layer 150 is rolled off the backing 20 and then the backing 20 is discarded. This is described in the following paragraph.

Figure 12:
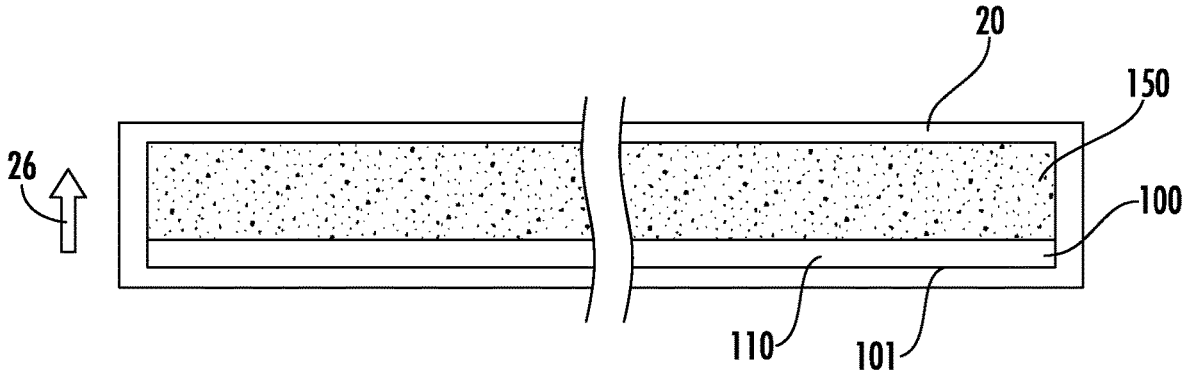
FIG. 12 is a top view of the carbon fiber blank aligned with the edge of the reinforcing layer applied to the backing.

FIG. 12 is a top view of cylindrical tube 101, with unfinished exterior surface 110, aligned along the edge of reinforcing layer 150. Firm downward pressure is applied to cylindrical tube 101 to adhere the reinforcing layer 150 to the unfinished exterior surface 110. Next, cylindrical tube 101 is rotated, maintaining firm downward pressure, such that cylindrical tube 101 rolls in direction 26, thereby adhering reinforcing layer 150 such that it covers the exterior surface 110 of cylindrical tube 101. While cylindrical tube 101 is rotated, reinforcing layer 150 detaches from backing 20.

Figure 13:
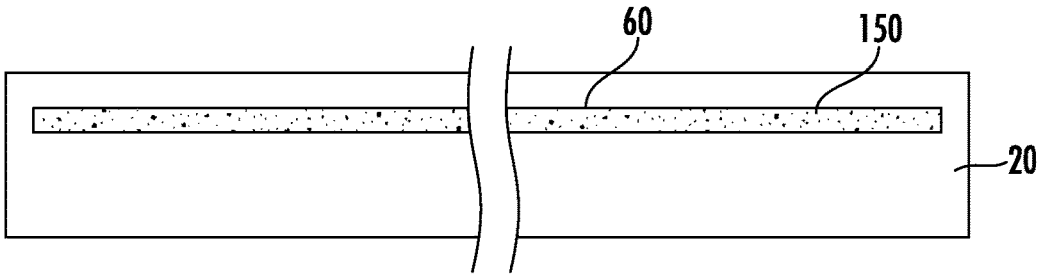
FIG. 13 is a top view of the reinforcing layer applied to the carbon fiber blank, leaving the backing void of the reinforcing layer.

FIG. 13 is a perspective view of cylindrical tube 101 after rolling reinforcing layer 150 on to exterior surface 110 (not shown) of cylindrical tube 101. As described above in relation to FIG. 12, reinforcing layer 150 has completely detached from the backing 20.

Figure 14:
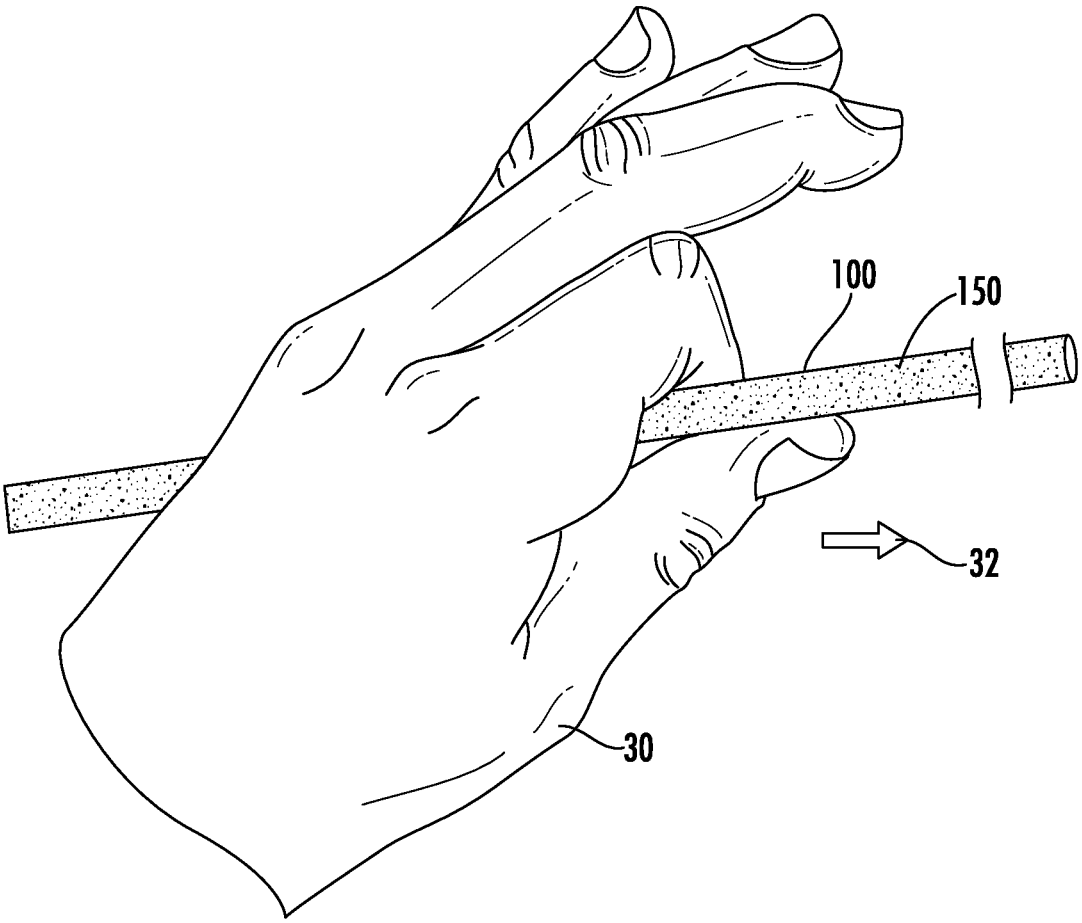
FIG. 14 is a perspective view of the carbon fiber blank with applied reinforcing layer being hand checked for quality.

FIG. 14 is a perspective view of carbon fiber blank 100 having reinforcing layer 150 applied, showing a hand 30 with its index finger and thumb wrapped around carbon fiber blank 100 having reinforcing layer 150 such that a tight seal is formed between the fingers and carbon fiber blank 100 having reinforcing layer 150. Hand 30 is then slid along carbon fiber blank 100 having reinforcing layer 150 in direction 32 to remove any bubbles and imperfections from the reinforcing layer 150.

After the bubbles and imperfections are removed, carbon fiber blank 100 having reinforcing layer 150 is cleaned to remove impurities and solvent. Carbon fiber blank 100 having reinforcing layer 150 is then inspected for defects. If any exist, reinforcing layer 150 is removed and a new reinforcing layer 150 applied. The defect free carbon fiber blank 100 having reinforcing layer 150 is then flashed at a first temperature for thirty minutes, followed by curing at a second temperature for one hour. In a preferred process, the first temperature is 140° F. and the second temperature is 210° F. After curing, it is cooled to ambient temperature then inspected for defects. If defects are found, it is rejected.

Figure 15:
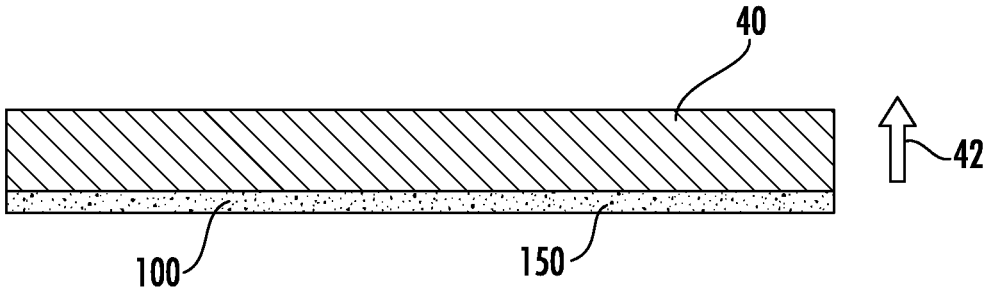
FIG. 15 is a top view of the carbon fiber blank with applied reinforcing layer having a finishing layer applied on top of the reinforcing layer.

FIG. 15 is a top view of reinforcing layer 150 cured onto carbon fiber blank 100, then aligned with a finishing layer 40. A section of finishing layer 40 is cut to the desired dimensions and placed on a flat surface. Carbon fiber blank 100 with applied reinforcing layer 150 is aligned along the edge of finishing material 40 then rotated such that carbon fiber blank 100 with applied reinforcing layer 150 rolls in direction 42, thereby causing finishing layer 40 to fully cover the reinforcing layer 150. It is to be appreciated by someone skilled in the art that finishing layer 40 will become transparent when cured. After finishing layer 40 is fully applied to the carbon fiber blank 100 with applied reinforcing layer 150, finishing layer 40 is inspected for defects. If any defects are found, finishing layer 40 is removed then reapplied until no defects are found.

Figure 16:
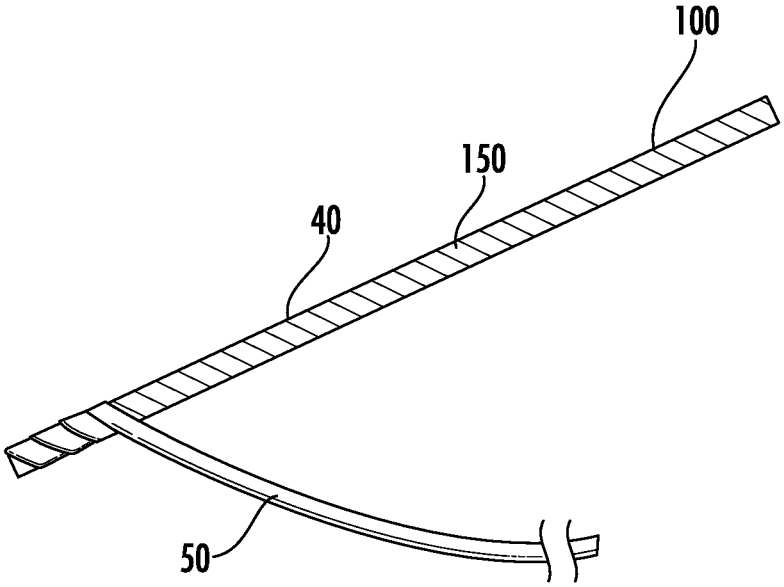
FIG. 16 is a perspective view of the carbon fiber blank with applied reinforcing layer and finishing layer having a cellophane-like material wrapped around the arrow.

FIG. 16 is a perspective view of carbon fiber blank 100 with applied reinforcing layer 150 wrapped in finishing layer 40. Cello film 50 is then wrapped around carbon fiber blank 100 with applied reinforcing layer 150 over finishing layer 40 until finishing layer 40 is completely covered. Cello film 50 holds finishing layer 40 in place during the curing process. Carbon fiber blank 100 with applied reinforcing layer 150 with finishing layer 40 wrapped in cello film 50 is then cured at a temperature for one hour, and then cooled to ambient.

After carbon fiber blank 100 with applied reinforcing layer 150 and finishing layer 40 is cooled to ambient, cello film 50 is fully removed. The nature of cello film 50 is to leave behind marks on the cured finishing layer 40. The carbon fiber blank 100 with applied reinforcing layer 150 and finishing layer 40 is then polished such that only the marks from cello film 50 are removed leaving finishing layer 40 smooth and intact. If it is polished excessively, finishing layer 40 may be removed in some areas causing those areas to "fuzz up," thereby degrading the finished look of reinforced arrow shaft 10 and possibly causing finished reinforced arrow shaft 10 to be rejected.

In an alternative embodiment, a contracting sleeve may be used to impart uniform pressure against the carbon fiber blank 100 with applied reinforcing layer 150 and finishing layer 40. The uniform pressure created by the contracting sleeve ensures the reinforcing layer 150 and finishing layer 40 is held in place on the carbon fiber blank 100 during the curing process. The carbon fiber blank 100 with applied reinforcing layer 150 and finishing layer 40 wrapped in the contracting sleeve is then cured at a temperature for one hour, and then cooled to ambient. The contracting sleeve used may be made of silicone or any other material with contracting characteristics.

In another alternative embodiment, a pressure vessel may be used to impart uniform pressure against the carbon fiber blank 100 with applied reinforcing layer 150 and finishing layer 40. The uniform pressure created by the pressure vessel ensures the reinforcing layer 150 and finishing layer 40 is held in place on the carbon fiber blank 100. The carbon fiber blank 100 with applied reinforcing layer 150 and finishing layer 40 in the pressure vessel is then cured at a temperature for one hour, and then cooled to ambient.

Figure 17:
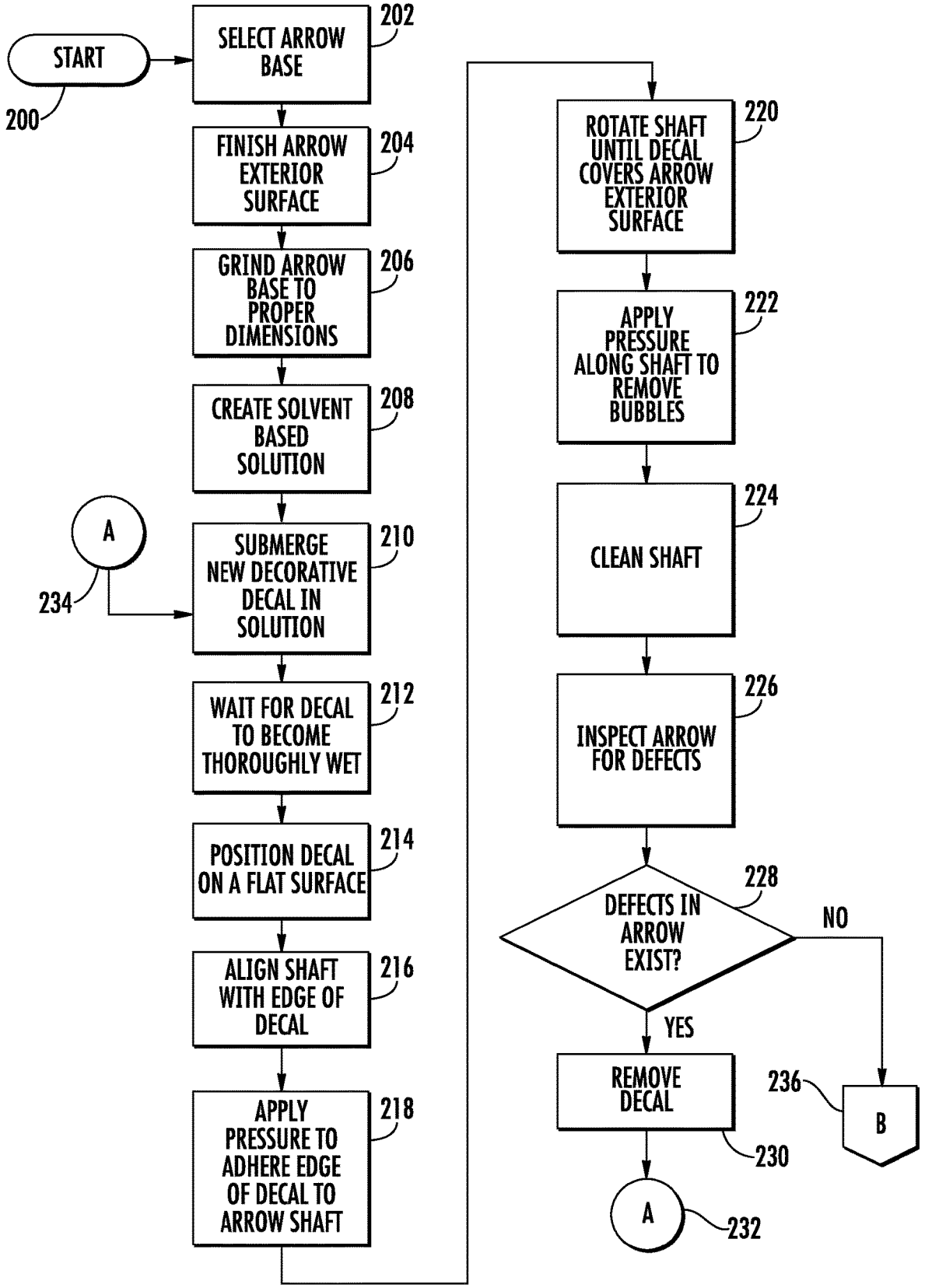
FIG. 17 is an exemplary flow chart showing the process steps used to create the reinforced arrow.
Figure 18:
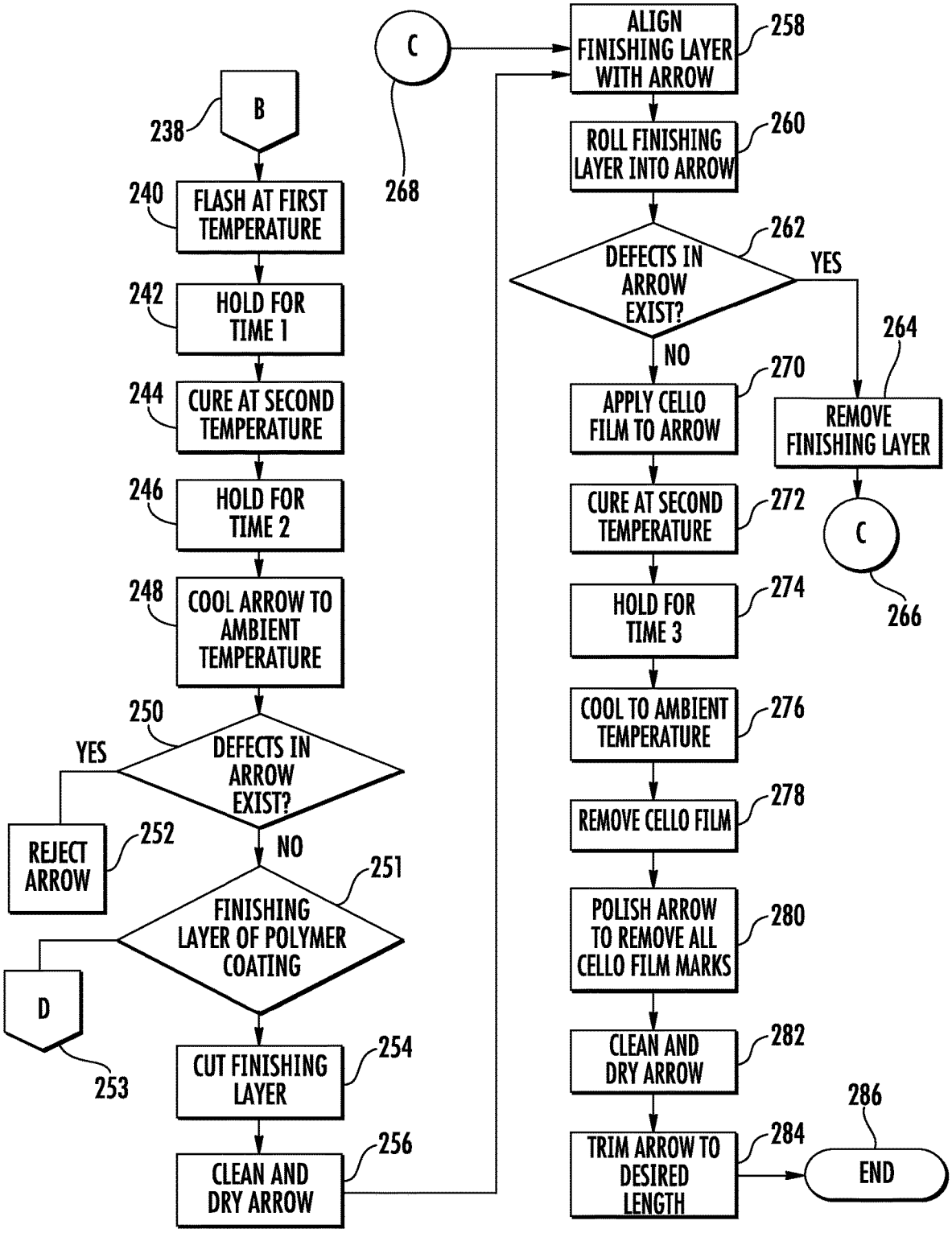
FIG. 18 is an exemplary flow chart showing the process steps used to create the reinforced arrow.
Figure 19:
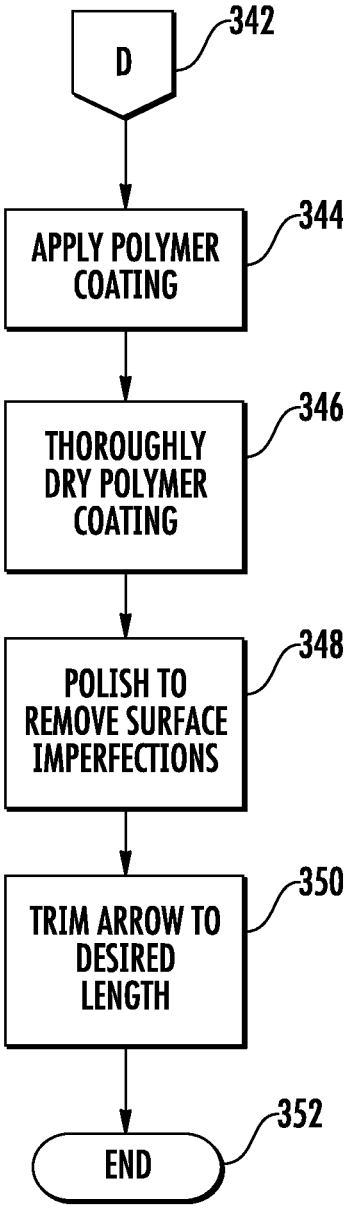
FIG. 19 is an exemplary flow chart showing the process steps used to create the reinforced arrow.

Referring now to FIGS. 17-19, a flow chart of an exemplary manufacturing process of the present invention is shown. The process starts at step 200. In step 202, a carbon fiber blank 100 is selected that is cylindrical tube 101 with exterior surface 110. In step 204, the selected cylindrical tube 101 is ground to the proper dimensions. Next, a solvent based solution 24 is created in step 208. In a preferred embodiment, 16-18 parts water is combined with one part solvent to create solution 24. In step 210, a reinforcing layer 150, with backing 20, is submerged in solution 24. In step 212, both reinforcing layer 150 and backing 20 are submerged until both become thoroughly wet. In a preferred embodiment, reinforcing layer 150 and backing 20 are submerged for 5-10 seconds. However, differing reinforcing layers 150 may require the use of solutions 20 containing different solvents at different concentrations and wetted for different periods of time and are fully contemplated. Further, reinforcing layer 150 may only require water or solvent instead of both to prepare it for use.

In step 214, the wetted reinforcing layer 150 with backing 20 is placed on a flat surface. In a preferred embodiment of the process, wetted reinforcing layer 150 with backing 20 may be placed on a sheet of foam, such as Styrofoam, or any other material that conforms to the shape of a surface pressed upon it and which provides adequate friction to prevent the surface pressed upon it from movement, such as backing 20. Step 216 has cylindrical tube 101 aligned with a lengthwise edge of the reinforcing layer 150. In step 218, downward pressure is applied to cylindrical tube 101 to adhere the reinforcing layer to the exterior surface 110 of the cylindrical tube 101. In step 220, cylindrical tube 101 is then rolled in direction 26 until reinforcing layer 150 is fully transferred from the backing 20 to the cylindrical tube 101, thereby covering exterior surface 110 of the cylindrical tube 101.

After transferring reinforcing layer 150 to carbon fiber blank 100, step 222 has pressure applied along the length of the carbon fiber blank 100 to remove bubbles and imperfections in reinforcing layer 150. Arrow 60 at that point is a carbon fiber blank 100 with reinforcing layer 150 applied to it. In a preferred process, an index finger and thumb of hand 30 are wrapped tightly around arrow 60, and then slid in direction 32 to remove bubbles and imperfections. However, use of a tool that forms a seal around arrow 60 that can be slid along the length of arrow 60 to remove bubbles and imperfections are fully contemplated. Step 226 then has arrow 60 inspected for defects. If defects exist in arrow 60, step 228 directs the process to step 230, which has the reinforcing layer 150 removed from carbon fiber blank 100. Step 230 directs the process to connector 232, which in turn directs the process to connector 234. Connector 234 directs the process back to step 210 to have a new reinforcing layer 150 prepared for application to carbon fiber blank 100. If no defects exist in arrow 60, step 228 directs the process to off-sheet connector 236, which connects to off-sheet connector 238.

Connector 238 directs the process to step 240, which has arrow 10 flashed at a first temperature to remove any moisture from arrow 60. In step 242, arrow 60 is held at the first temperature for Time 1, thirty minutes. In step 244, arrow 60 is cured at a second temperature. In a preferred process, the second temperature is higher than the first temperature. Then in step 246, arrow 60 is held at the second temperature for Time 2, one hour. Step 248 has arrow 60 cooled to ambient temperature. Next, in step 250, arrow 60 is inspected for defects. If a defect exists, step 252 has arrow 60 rejected. If no defects exist, the process is directed to step 251. Step 251 guides the process depending if a polymer layer or a finishing layer is used.

If a polymer layer is used, the process is guided to connector 253 which connects the process path to connector 342 shown in FIG. 19, which leads to step 344 where a polymer coating is applied to arrow 60. After the polymer coating is applied in step 344, the process moves to step 346 where the polymer coating is allowed to fully dry. At this point in the process, arrow 60 is the carbon fiber blank 100, reinforcing layer 150, and polymer coating. Next, in step 348, arrow 60 is polished to remove surface imperfections in the polymer coating. Lastly, arrow 60 is trimmed to the desired length. This branch of the process ends at step 352.

If a finishing layer 40 is used, the process is guided to step 254. In step 254, finishing layer 40 is cut to the desired dimensions. Step 256 has arrow 60 cleaned and dried. In step 258, arrow 60 is aligned with the edge of finishing layer 40. In step 260, arrow 60 is rolled to wrap finishing layer 40 around arrow 60. In step 262, arrow 60 is inspected for defects. If a defect exists, the process goes to step 264 where the finishing layer 60 is removed. Step 264 then guides the process to connector 266, which leads the process to connected 268 back to step 258 where finishing layer 40 is aligned with arrow 60. If there are no defects in arrow 60, step 262 guides the process to step 270, where arrow 60, now wrapped in finishing layer 40, is wrapped with a cellophane-like film 50 with at least one layer of film 50 covering finishing layer 40.

After arrow 60 is wrapped in step 270, the process moves to step 272 where arrow 60, finishing layer 40, and film 50 are cured at a second temperature. Step 274 has arrow 60 held at the second temperature for Time 3, one hour. At the end of the hour in step 274, step 276 has arrow 60 cooled to ambient. Next, in step 278, film 50 is removed. At this point in the process, arrow 60 is the carbon fiber blank 100, reinforcing layer 150, and finishing layer 40. In step 280, arrow 60 is polished to remove only the marks created by film 50 in finishing layer 40. Next, in step 282, arrow 60 is cleaned and dried. Lastly, in step 284, arrow 60 is trimmed to the desired length. The process then ends with step 286.

In one embodiment of the invention, the arrow shaft is made in accordance with the following steps. Pre-preg, 304 stainless steel woven mesh, and glass scrim are arranged on a mandrel so that the pre-preg layer is in contact with the mandrel and the glass scrim is the layer farthest from the mandrel. Cello wrapping is applied to outside of the glass scrim layer using a horizontal cello wrapping machine. After the cello is wrapped around the outside of the pre-preg, stainless steel mesh, and glass scrim, the combined layers are placed in an oven with the mandrel to fully cure. Once cured, the shaft is removed from the oven. The outer cello wrapping is removed and/or stripped away from the shaft. The mandrel is then removed from the inside of the shaft. The shaft is then ground to the appropriate spine and outside diameter. Only the top layer of the glass scrim material will be ground making sure that there is no contact between the grinder and the stainless steel mesh.

While the particular reinforced arrow shaft and the process of manufacturing such as herein shown and disclosed in detail is fully capable of obtaining the objects and providing the advantages herein before stated, it is to be understood that it is merely illustrative of the presently preferred embodiments of the invention and that no limitations are intended to the details of construction, design, and process herein shown other than as described in the appended claims.

The above description sets forth, rather broadly, a summary of the disclosed embodiments. There may be, of course, other features of the disclosed embodiments that will be appreciated by a person of skill in the art based on the description and may form the subject matter of claims. The features, functions, and advantages that have been discussed can be achieved independently in various embodiments of the disclosure or may be combined in yet other embodiments, further details of which can be seen with reference to the description and drawings.

The order in which the steps are presented is not limited to any particular order and does not necessarily imply that they have to be performed in the order presented. It will be understood by those of skill in the art that the order of these steps can be rearranged and performed in any suitable manner. It will further be understood by those of skill in the art that some steps may be omitted or added and still fall within the spirit of the invention. Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and not for purposes of limitation. The invention is not limited in its application to the details of the construction and to the arrangement of the components set forth in the above description or as illustrated in the drawings. While it has been shown what are presently considered to be preferred embodiments of the present invention, it will be apparent to those skilled in the art that various changes and modifications can be made herein without departing from the scope and spirit of the invention.

What is claimed is:

1. A reinforced arrow shaft for an archery arrow or a crossbow bolt, the arrow shaft formed from materials consisting essentially of a carbon fiber blank, a sheet of metal mesh, and a glass scrim material, and prepared by a method comprising:

wrapping a carbon fiber material pre-impregnated with a resin round a mandrel to form a carbon fiber blank, wherein the carbon fiber blank consists of a cylindrical tube having a longitudinal axis; an inside diameter spanning the longitudinal axis; and an outside diameter spanning the longitudinal axis;

rolling a sheet of metal mesh around the carbon fiber blank to form at least one reinforcing layer having a length substantially equal to the length of the cylindrical tube and a width substantially equal to the circumference of the cylindrical tube;

rolling a glass scrim material around the carbon blank having the reinforcing layer;

curing the carbon fiber blank having the reinforcing layer and the glass scrim material under pressure;

removing the mandrel from inside the arrow shaft; and grinding the glass scrim material to provide the arrow shaft with a predetermined static spine and exterior diameter, the static spine defining the stiffness of the arrow shaft and its resistance to bending, wherein the diameter of the mandrel defines the interior diameter of the arrow shaft, and the amount of carbon fiber material wrapped around the mandrel in conjunction with the thickness of the reinforcing layer defines the exterior diameter of the arrow shaft, and wherein the metal mesh has at least 80×80 wires per square inch and adds about 1.2 grains/inch to the arrow shaft's weight.

2. The arrow shaft of claim 1 wherein the sheet of metal mesh comprises at least one of aluminum, steel, stainless steel, brass, titanium, nickel, silver, and nitinol.

3. The arrow shaft of claim 1 wherein the sheet of metal mesh comprises wire having a diameter less than 0.0032 inches.

4. The arrow shaft of claim 1 wherein the sheet of metal mesh comprises wire having a diameter from 0.001 inches to 0.0032 inches.

5. The arrow shaft of claim 1 wherein the sheet of metal mesh comprises wire having a diameter from 0.001 inches to 0.002 inches.

6. The arrow shaft of claim 1 wherein the sheet of metal mesh is woven.

7. The arrow shaft of claim 1 wherein the sheet of metal mesh is knitted.

8. The arrow shaft of claim 1 wherein the sheet of metal mesh is an alloy.

9. The arrow shaft of claim 1 wherein the method further comprises wrapping a cellophane-like film around the finishing layer; performing the curing; and removing the cellophane-like film.

10. The arrow shaft of claim 1 wherein the method further comprises applying a contracting sleeve around the finishing layer; performing the curing; and removing the contracting sleeve.

11. The arrow shaft of claim 1 wherein the method further comprises performing the curing in a pressure vessel.

* * * * *